United States Patent [19]

Hoskins

[11] 4,327,490

[45] May 4, 1982

[54] CAN OPENER

[76] Inventor: Nathan D. Hoskins, 6 Maywood Dr., Jackson, Tenn. 38301

[21] Appl. No.: 167,741

[22] Filed: Jul. 14, 1980

[51] Int. Cl.[3] ..... B67B 7/32; B67B 7/44

[52] U.S. Cl. ..... 30/408; 30/410; 30/142; 7/152

[58] Field of Search ..... 7/152, 156; 30/420, 30/408, 410, 123 R, 142, 294, 416

[56] References Cited

U.S. PATENT DOCUMENTS

| | | | |
|---|---|---|---|
| 1,617,142 | 2/1927 | Asbury | 30/420 |
| 2,072,333 | 3/1937 | Hosmer | 30/410 |
| 2,237,418 | 4/1941 | Fender | 30/416 |
| 2,718,055 | 9/1955 | Frins | 30/420 |
| 3,108,372 | 10/1963 | Hoskins | 30/420 |
| 3,365,798 | 1/1968 | Cunningham | 30/294 X |
| 3,942,247 | 3/1976 | Ponczek | 30/408 |

*Primary Examiner*—Nicholas P. Godici
*Attorney, Agent, or Firm*—Young & Thompson

[57] ABSTRACT

A pocket can opener comprises a body with a propelling wheel and a handle for rotating the propelling wheel and a cutter blade pivotally attached to the body so that both the handle and the cutter blade can fold down across the body with the cutter blade overlying and being of such a size as to cover the propelling wheel when the can opener is in inoperative condition. The cutter blade also provides a bottle opener at its free end having a longer arm and a shorter arm, the longer arm being shaped also as an opener for pressed-on jar lids, this latter opener structure being so arranged as to take up no additional space in the folded condition of the parts. Also, a further blade is pivoted on the first-mentioned blade and has sharpened edges for puncturing and slitting aluminum or plastic or other packaging materials for food products and is so constructed as to lie flat against and be masked by the longer arm of the bottle opener in its inoperative condition but to project freely and have purchase against a guide bar of the can opener in its operative condition, in which latter case the first-mentioned cutter blade becomes in effect part of a handle for the puncturing and slitting blade.

5 Claims, 3 Drawing Figures

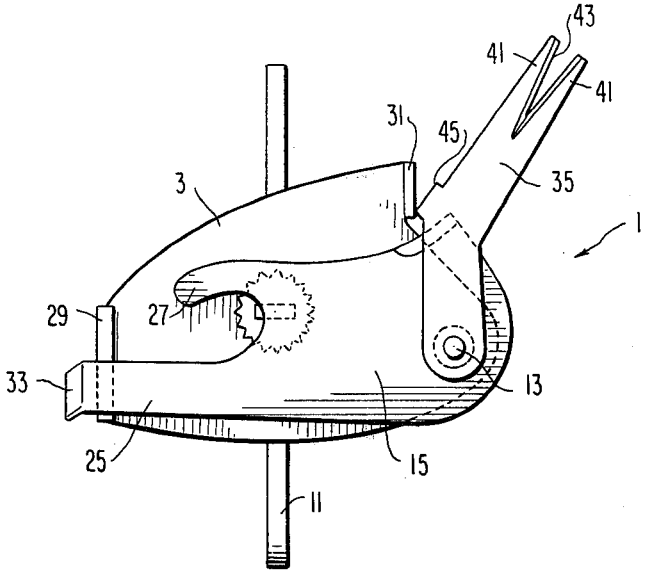
FIG. 1
FIG. 2
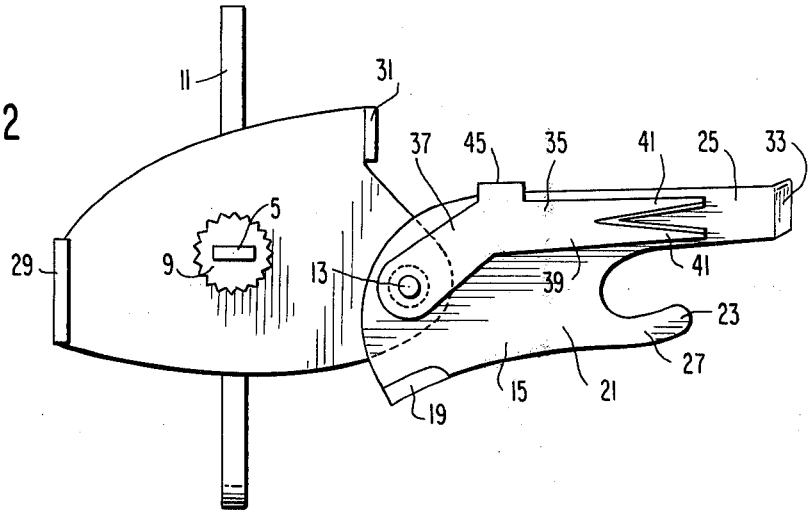
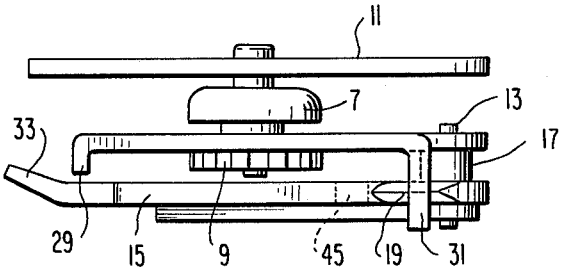
FIG. 3

CAN OPENER

The present invention relates to can openers, more particularly of the type in which a propelling wheel engages beneath the upper rib of the can so that upon turning the propelling wheel a cutter blade is dragged about the periphery of the can lid thereby to separate the lid from the can rim.

The present invention is an improvement on the can opener disclosed in my U.S. Pat. No. 3,108,372, the disclosure of which is incorporated herein by reference so as to avoid prolixity of disclosure.

It is an object of the present invention to provide a can opener that will fold to a desirably small and compact size and shape for carrying in the pocket or the like.

Another object of the present invention is the provision of a can opener, which performs additional functions with no increase in the size of the opener.

Still another object of the present invention is the provision of a can opener performing multiple functions, in which the parts that are inoperative are masked by the parts that are operative.

A further object of the present invention is the provision of a can opener having multiple functions, in which the parts that are inoperative coact to provide a handle for the parts that are operative.

Finally, it is an object of the present invention to provide a can opener which will be relatively simple and inexpensive to manufacture, safe and easy to carry and operate, and rugged and durable in use.

Other objects, features and advantages of the present invention will become apparent from a consideration of the following specification, taken in connection with the accompanying drawing, in which:

FIG. 1 is a side elevational view of a can opener according to the present invention, with the parts in the position they occupy during the puncturing and slitting of a flexible container for food;

FIG. 2 is a view similar to FIG. 1, but showing the parts in the position they occupy when the opener is used to loosen pressed-on jar lids or for other purposes; and FIG. 3 is a side view of the structure shown in FIGS. 1 and 2, but with the parts in their folded relationship.

Referring now to the drawing in greater detail, there is shown a can opener indicated generally at 1 for use with a cylindrical can of the usual construction, having a top and a rim by which the top is connected to the usual cylindrical side wall of the can. as is usual, the rim projects above the top of the can and outward from the side wall of the can.

The can opener 1 comprises a body 3 in the form of a generally flat strip of metal. Approximately centrally of body 3, a shaft 5 projects through body 3 and carries on one side of and close to body 3 a head 7 and on the other side of and close to body 3 a propelling wheel 9 having a serrated periphery to engage under the rim of the can to propel the opener about the can. Head 7 carries a handle 11 in the form of a flat strip of metal, handle 11 being joined to head 7 for pivotal movement about an axis parallel to body 3 and as close as possible to body 3, so that when handle 11 folds parallel to body 3 it will be as close to body 3 as is practical.

As noted above, body 3 is generally elongated, and adjacent one end thereof and quite close to the end edge of body 3 a pivot pin 13 extends through a flat portion of body 3. Pin 13 is simply headed over on the same side as handle 11, but on the same side as wheel 9 pin 13 carries a cutter blade 15 mounted for pivotal movement thereon about the axis of pivot pin 13 which in turn is perpendicular to the plane of body 3 and blade 15. A metal washer 17 spaces blade 15 from body 3 a distance about the same as or only slightly greater than the thickness of propelling wheel 9.

Cutter blade 15 has a cutting edge 19 thereon at one end, the bulk of the remainder of blade 15 providing a handle 21 having at its end remote from pin 13 and edge 19 a bottle opener 23. Opener 23 comprises a longer arm 25 that bears against the top of a bottle lid, and a shorter arm 27 which is of conventional hooked configuration for engaging under the lip of a bottle cap to open the bottle.

At the end of body 3 remote from pivot pin 13, a guide projection 29 extends to the same side as wheel 9 a distance about the thickness of wheel 9. At the same end of body 3 as blade 15, a guide bar 31 projects outward to the same side of body 3 as guide projection 29 but to a greater distance, so that bar 31 extends outward beyond the outer surface of blade 15.

As in my earlier patent, when the device is used as a can opener, projection 29 engages against the cylindrical side wall of the can while bar 31 overlies and rests on the rim of the can.

As thus far described, the structure and function of the device can be substantially the same as in my above-identified patent. Thus, the can opening function and the can opening structure of the present invention are the same as in that patent. One departure from the disclosure of that patent, however, is that the longer arm 25 of bottle opener 23, in the present invention, is made somewhat wider than in the patent, because it performs two uniquely new functions in the present invention.

One of the new functions of longer arm 25 of bottle opener 23, is to serve as the support for a lip 33 that extends obliquely from the outer end of arm 25, in the same direction as body 3. Lip 33 has bevelled end edges to reduce its thickness at the very end thereof, to facilitate insertion of lip 33 under the pressed-on lid of a jar, after which, with the parts in the FIG. 2 position, the entire can opener can be used as a handle to pry up the jar lid.

It is important to notice a few relationships of the parts in connection with the lip 33. In the first place, the bend line at which lip 33 joins arm 25, is substantially tangent to an imaginary circle whose center is pivot pin 13. This ensures that lip 33 will be used in such a way as to impose substantially no torque about pin 13, with the result that when the parts are in the FIG. 2 position, the entire opener can be used as a handle for prying up jar lids, with substantially no tendency for the handle to collapse about pin 13. To this same end, that bend line is perpendicular to the length of longer arm 25.

It is also important to notice that, when blade 15 is in the collapsed position of FIGS. 1 and 3, lip 33 does not increase the size of the device in any way. This is because, in that folded position, lip 33 extends in the opposite direction from guide projection 29, with the result that lip 33 and projection 29 in effect overlie each other edgewise of the device. Moreover, the length of longer arm 25 does not have to be increased to include lip 33, as a longer arm 25 is needed in any event for the bottle opener 23.

Another very important novel feature of the present invention, is the provision of an additional blade 35 mounted for pivotal movement about pivot pin 13 on the side of blade 15 that is opposite body 3. Blade 35 comprises a base portion 37 which at one end pivots on pivot pin 13 and which merges into a somewhat longer end portion 39 disposed at an obtuse angle to base portion 37. End portion 39 terminates in two long slender legs 41 whose outer edges are almost parallel to each other and whose inner edges are sharpened to provide sharpened edges 43. A tongue 45 bent from blade 35 in the same direction as lip 33 but perpendicular to blade 35, overlies and rests against the adjacent edge of blade 15 in the FIG. 2 position, which is the inoperative position of blade 35, thereby to ensure that end portion 39 and legs 41 of blade 35 will overlie and be masked by longer arm 25 of opener 23. In this position of the parts, as well as in the completely folded position of the parts shown in FIG. 3, sharpened edges 43 cannot come into harmful contact with anything. It is this masking function of longer arm 25 that constitutes another of its new functions.

The purpose of blade 35 is to serve as a punch and slitter for flexible packaging for foodstuffs, such as the aluminum and/or plastic containers in which many foodstuffs are sold. The operative position of blade 35 for the purpose is shown in FIG. 1. With the parts in that position, body 3 and blade 15 together serve as a handle for blade 35; while guide bar 31 contacts tongue 45 to prevent further swinging movement of blade 35 counterclockwise about pivot pin 13 as seen in FIG. 1. In this supported position of blade 35, one of the legs 41 can be used as a punch to puncture the flexible packaging material, after which the sharpened edges 43 can be used as a slitter to slit the punctured material. It is not necessary that the ends of legs 41 be sharpened beyond the condition shown in the drawing, because the flexible packaging material for foodstuffs does not require such sharpened points and the safety of the device militates against such sharpened points.

Although the tongue 45 is shown in FIG. 1 as contacting guide bar 31, it is not necessary that tongue 45 ever contact guide bar 31. Instead, an edge of blade 15 spaced from tongue 45 could also contact guide bar 31, to give purchase to blade 35 during the use of blade 35. An important relationship of the parts of the present invention, however, is that guide bar 31, in addition to its can opening function, also provide the function of a stop for blade 35.

Guide bar 31 also takes on another new function in the present invention, as compared to its function in my earlier patent. It will be recalled that, in my earlier patent, guide bar 31 served to mask the cutting edge 19 in the folded or carrying position of the parts, so that the cutting edge would not cut, for example, the fabric of a pocket in which the opener was carried.

But in the present invention, the guide bar 31 not only masks cutting edge 19 in the fully collapsed position of the parts shown in FIG. 3, but also masks cutting edge 19 in the FIG. 1 position of the parts, when body 3 and blade 15 are folded together to serve as a handle. Thus, use of the blade 35 in the FIG. 1 position, requires the user to grasp body 3 and blade 15 together; and the presence of guide bar 31, as well as the fact that base portion 37 of blade 35 partially overlies cutting edge 19 in the FIG. 1 position, ensures that there can be no contact between cutting edge 19 and the hand that grasps the opener.

If such care is taken to mask cutting edge 19 in the FIG. 1 position of the parts, then it may be wondered why no provision is made for masking cutting 19 in the FIG. 2 position of the parts, in which the device serves to pry open jar lids. This is because in the FIG. 2 position, the opener is swung about lip 33 as a fulcrum, in a direction perpendicular to cutting edge 19, which cutting edge accordingly is not likely to cause injury.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a pocket can opener comprising a body with a propelling wheel and a handle for rotating the propelling wheel and a cutter blade pivotally attached to the body so that both the handle and the cutter blade can fold down across the body with the cutter blade overlying and being of such size as to cover the propelling wheel when the can opener is in inoperative condition; the improvement comprising a second blade pivotally mounted on the same pivot as the first blade and on the side of the first blade opposite the body, said second blade having a pair of legs whose confronting surfaces are sharpened edges for slitting flexible packaging material.

2. An opener as claimed in claim 1, and a tongue on said second blade that contacts said first blade in the inoperative condition of the second blade to maintain the second blade in a position in which said second blade is masked by said first blade.

3. An opener as claimed in claim 1, said first blade being pivotally mounted on said body adjacent one end of said first blade and having a bottle opener at the other end of said first blade, said bottle opener having a longer arm for engaging the tops of bottle caps and a shorter arm for engaging under the rims of bottle caps, and means positioning said second blade in an inoperative position relative to said first blade in which said second blade overlies and is masked by said longer arm.

4. An opener as claimed in claim 1, said body having a guide bar that overlies and rests on the rim of a can during a can opening operation, said second blade engaging said guide bar in an extended position of said second blade whereby said guide bar limits rotation of said second blade about said pivot.

5. An opener as claimed in claim 4, said first blade having a cutting edge thereon for opening cans, said cutting edge being masked by said body and by said second blade and by said guide bar when said first blade is folded against said body and said second blade is in contact with said guide bar.

* * * * *